US011433522B2

(12) United States Patent
Feng et al.

(10) Patent No.: US 11,433,522 B2
(45) Date of Patent: Sep. 6, 2022

(54) NAILING APPARATUS

(71) Applicant: BEIJING DAFENG TECHNOLOGY LTD., Beijing (CN)

(72) Inventors: Zezhou Feng, Beijing (CN); Yue Fan, Beijing (CN); Zhiwen Liao, Beijing (CN)

(73) Assignee: BEIJING DAFENG TECHNOLOGY LTD., Beijing (CN)

( * ) Notice: Subject to any disclaimer, the term of this patent is extended or adjusted under 35 U.S.C. 154(b) by 210 days.

(21) Appl. No.: 16/770,044

(22) PCT Filed: Dec. 3, 2018

(86) PCT No.: PCT/CN2018/118979
§ 371 (c)(1),
(2) Date: Jun. 4, 2020

(87) PCT Pub. No.: WO2019/109892
PCT Pub. Date: Jun. 13, 2019

(65) Prior Publication Data

US 2021/0237240 A1 Aug. 5, 2021

(30) Foreign Application Priority Data

Dec. 4, 2017 (CN) ..... 201711261438.5
Dec. 4, 2017 (CN) ..... 201711261483.0

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
CPC ..... B25C 1/04–047; B25C 1/008; B25C 1/06
See application file for complete search history.

(56) References Cited

U.S. PATENT DOCUMENTS 3,299,967 A 1/1967 Cabot et al.
8,459,519 B2 * 6/2013 Feng ..... B25C 1/06 227/132

(Continued)

FOREIGN PATENT DOCUMENTS

CN 1701923 A 11/2005
CN 2767071 Y 3/2006

(Continued)

OTHER PUBLICATIONS

Extended European Search Report for European Application No. 18886337.7 dated Jan. 21, 2019 (7 pages).

(Continued)

*Primary Examiner* — Anna K Kinsaul
*Assistant Examiner* — Veronica Martin
(74) *Attorney, Agent, or Firm* — Brandon V. Zuniga; James R. Gourley; Carstens & Cahoon, LLP

(57) ABSTRACT

A nailing apparatus, comprising: a support mechanism, and an energy storage mechanism and an energy storage driving mechanism both provided in the support mechanism, wherein the energy storage driving mechanism comprises a power component, an eccentric component connected to the power component and a linear movement component connected to the eccentric component, and the power component comprises a driving electric motor and a step-down gear installed on an output shaft of the driving electric motor; a nailing driving mechanism, wherein the energy storage driving mechanism drives the nailing driving mechanism to hammer nail to drive the nail into a base material.

10 Claims, 9 Drawing Sheets

(56) References Cited

U.S. PATENT DOCUMENTS

| | | | | |
|---|---|---|---|---|
| 2008/0190988 | A1* | 8/2008 | Pedicini | B25C 1/04 137/540 |
| 2011/0095066 | A1 | 4/2011 | Feng et al. | |
| 2014/0076951 | A1* | 3/2014 | Brendel | B25C 1/06 227/8 |

FOREIGN PATENT DOCUMENTS

| | | | |
|---|---|---|---|
| CN | 107984429 | A | 5/2018 |
| CN | 108000440 | A | 5/2018 |
| DE | 3603870 | A1 | 8/1987 |
| JP | 2008155369 | A | 7/2008 |
| JP | 2009166155 | A | 7/2009 |
| JP | 4922672 | B2 | 4/2012 |
| JP | 2013233608 | A | 11/2013 |

OTHER PUBLICATIONS

International Search Report for Application No. PCT/CN2018118979 dated Mar. 13, 2019 (2 pages).
Office Action from Japanese Application No. 2020-549853 dated Jul. 6, 2021 (3 pages).

* cited by examiner

NAILING APPARATUS

CROSS-REFERENCE TO RELATED APPLICATION

The present disclosure claims the priority of Chinese Patent Application No. 201711261438.5, entitled "nailing device", filed on Dec. 4, 2017, the entire content of which is incorporated herein in its entirety. The present disclosure claims the priority of Chinese Patent Application No. 201711261483.0, entitled "nailing device", filed on Dec. 4, 2017, the entire content of which is incorporated herein in its entirety.

TECHNICAL FIELD

The present disclosure relates to a technical field of electric tools, and in particular relates to a nailing device.

BACKGROUND

In fields of engineering construction, house construction, indoor and outdoor decoration, furniture manufacturing, exhibition layout and the like, it is necessary to use nail guns to fix parts that are required to be fixed on a substrate. At present, pneumatic nail guns that use compressed air as a power source are widely used. However, the air pump, which is the power source of the pneumatic nail gun, is a relatively bulky device, which is inconvenient to move and carry. Therefore, the nail gun with electricity as the power source came into being. As for electric nail guns on the market, electric nail guns driven by electromagnetic coils mainly use mains supply as the power source. In the nail gun driven by the electromagnetic coil, not only need to drag an electric wire, which is inconvenient to use, but also the driving force of the electromagnetic coil is obviously insufficient, which cannot meet the actual needs of the engineering. From the perspective of development trends, it has been gradually replaced by so-called cordless nail guns powered by batteries.

At present, the main working method of the cordless nail guns is to drive an energy storage mechanism by a motor, and quickly release nail after energy storage. Energy storage mechanism includes: flywheel mechanism, spring mechanism, compressed air mechanism (compressed air mechanism can be divided into normal pressure mechanism and pre-compression mechanism (high pressure mechanism)). These methods have good applications in nail guns with a blow energy of less than 30 joules. However, the flywheel mechanism is complicated, and the energy is obviously limited and is difficult to be increased. The spring mechanism directly drives the nailing, which has a very poor effect. The compressed air mechanism, especially the pre-compression high-pressure mechanism, has a better nailing effect, which has a trend of leading the other two energy storage driving mechanism. However, such mechanism always has a problem of sealing, and thus seal life is the weakness of such mechanism. Therefore, the current electric nail guns have main problems of large friction loss, insufficient energy, low energy efficiency, and poor nailing effect, which affect the use.

SUMMARY

Accordingly, there provides a nailing device.

The above object is achieved by the following technical solutions.

A nailing device includes:

a supporting structure;

an energy storage mechanism provided in the supporting structure and capable of storing or releasing energy;

an energy storage driving mechanism provided in the supporting structure configured to drive the energy storage mechanism to store energy, wherein the energy storage driving mechanism includes a power component, an eccentric component connected to the power component, and a linear moving component connected to the eccentric component, the power component includes a driving motor and a decelerator mounted on an output shaft of the driving motor;

a transmission nailing mechanism, wherein the energy storage mechanism drives the transmission nailing mechanism to hit a nail, so as to drive the nail into a substrate;

wherein during energy storage, the power component drives the eccentric component to rotate, so as to drive the linear moving component to move linearly, and enable the energy storage mechanism to store energy; when energy storage mechanism releases energy, the energy storage mechanism drives the transmission nailing mechanism to hit the nail.

BRIEF DESCRIPTION OF THE DRAWINGS

In order to more clearly illustrate the technical solutions in the embodiments of the present disclosure or in the prior art, the drawings required in the description of the embodiments or in the prior art will be briefly introduced below. Obviously, the drawings in the following description are only some embodiments of the present disclosure. For those ordinary skills in the art, without paying any creative work, other drawings can also be obtained based on the disclosed drawings.

DETAILED DESCRIPTION OF THE EMBODIMENTS

The technical solutions in the embodiments of the present disclosure will be described clearly and completely in conjunction with the drawings in the embodiments of the present disclosure. Obviously, the described embodiments are only a part of the embodiments of the present disclosure, but not all the embodiments. Based on the embodiments in present disclosure, all other embodiments obtained by one of those ordinary skills in the art without creative work will fall within the scope of protection of the present disclosure.

Embodiment 1

A first embodiment of the present disclosure provides a nailing device capable of nailing a fixing element on a substrate, thereby enabling the fixing element to fix a component that is required to be fixed to the substrate. In this embodiment, the fixing element mainly refers to a nail. Of course, in other embodiments of the present disclosure, the fixing element may also be other fixing element similar to the nail. The nailing device according to the present disclosure obtains a large nailing force while having a compact structure, high energy efficiency, thereby improving the nailing effect.

Figure 9:
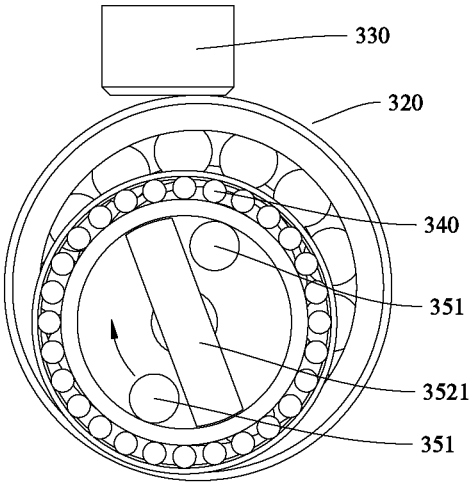
FIG. 9 is a schematic view of the energy storage driving mechanism in the nailing device shown in FIG. 1 in an energy release state.

As shown in FIGS. 1 to 4, a nailing device according to a first embodiment of the present disclosure includes a supporting structure 100, an energy storage mechanism 200, an energy storage driving mechanism 300, and a transmission nailing mechanism 400. The energy storage mechanism 200 is provided in the supporting structure 100. The energy storage mechanism 200 can store or release energy. The energy storage driving mechanism 300 is provided in the supporting structure 100, and is used to drive the energy storage mechanism 200 to store energy. The energy storage driving mechanism 300 includes a power component 310, an eccentric component 320 connected to the power component 310, a linear moving component 330 connected to the eccentric component 320, a one-way locking structure 340, and a position sensor. The one-way locking structure 340 is provided between the eccentric component 320 and the supporting structure 100. The one-way locking structure 340 restricts the eccentric component 320 to rotate in a single direction. The position sensor can sense the rotational position of the eccentric component 320. The power component 310 includes a driving motor 311 and a decelerator 312 mounted on an output shaft of the driving motor 311. The position sensor is electrically connected to the driving motor 311. The energy storage mechanism 200 drives the transmission nailing mechanism 400 to hit a nail, so as to drive the nail into a substrate. During energy storage, the power component 310 drives the eccentric component 320 to rotate, so as to drive the linear moving component 330 to move linearly, thus enabling the energy storage mechanism 200 to store the energy. When the energy storage mechanism 200 approaches the maximum energy storage, the eccentric component 320 is at a position close to the upper dead center, as shown in FIG. 9. When the position sensor senses that the eccentric component 320 approaches the upper dead center position, that is, when the eccentric component 320 is driven to a position 0° to 20° away from the upper dead center position, the driving motor 311 stops working, and the one-way locking structure 340 reversely locks the eccentric component 320. When receiving the nailing instruction, the driving motor 311 drives the eccentric component 320 to rotate, so as to pass the upper dead center position in a very short time. The energy storage mechanism 200 releases the energy, and drives the transmission nailing mechanism 400 to hit the nail, so as to drive the nail into the substrate. The cooperation of the position sensor, the one-way locking structure 340, and the motor achieves energy storage in advance and fast nailing of the nailing device, which saves the waiting time for nailing and improves the working efficiency of the nailing device.

The decelerator 312 is provided on output shaft of the driving motor 311. The eccentric component 320 is connected to an output end of the decelerator 312, and abuts against the linear moving component 330. The movement output by the driving motor 311 is decelerated by the decelerator 312 and then transmitted to the eccentric component 320, which can increase torque and improve an energy storage driving force for the energy storage mechanism 200. Optionally, the decelerator 312 is a planetary decelerator. The nailing device of the present disclosure can be connected to an alternating current (AC) power source to drive the nailing device. Of course, the nailing device of the present disclosure can also be powered by a battery.

Figure 3:
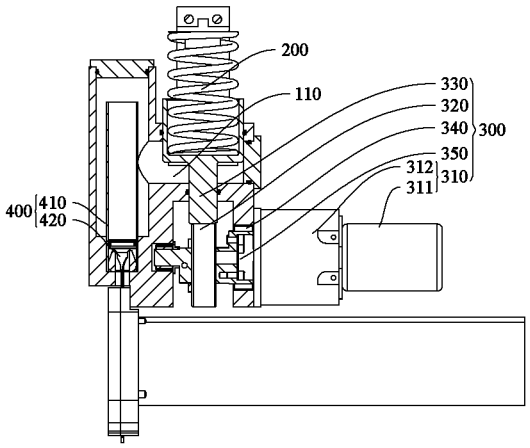
FIG. 3 is a cross-sectional schematic view of the nailing device taken along the line A-A shown in FIG. 1 in an energy release state.
Figure 4:
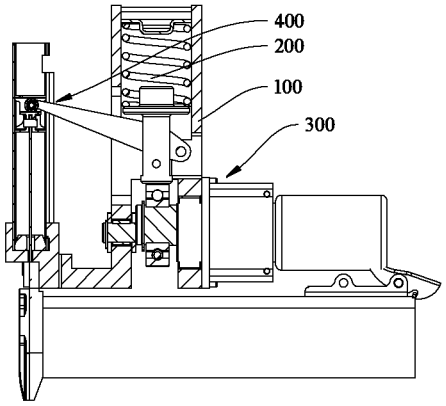
FIG. 4 is cross-sectional schematic view of the nailing device driven by a lever shown in FIG. 1.

In one of the embodiments, as shown in FIGS. 3 and 4, the linear moving component 330 includes a tappet. One end of the tappet abuts against the eccentric component 320, and the other end of the tappet is connected to the energy storage mechanism 200. Of course, in other embodiments of the present disclosure, the linear moving component 330 may also be other structures capable of moving linearly. The use of the tappet as the linear moving component 330 has the characteristics of simple structure, strong stability and high interchangeability.

In one of the embodiments, as shown in FIG. 3, the energy storage mechanism 200 includes an energy storage spring. The supporting structure 100 is provided with a mounting cavity. The energy storage spring is mounted in the mounting cavity of the supporting structure 100. The tappet can drive the energy storage spring to enable the energy storage spring to store the energy. When the energy storage spring releases the energy, the energy storage spring enables the tappet to move in the opposite direction. The energy storage spring is used to store and release the energy. An axis direction of the energy storage spring is parallel to a moving direction of the tappet, so as to avoid the deflection of the energy storage spring during the energy storage. One end of the energy storage spring is connected to the supporting structure 100, and the other end thereof is connected to the tappet. Further, the energy storage spring is a compression spring or a gas spring. The compression spring or the gas spring is provided in the supporting structure 100. One end of the compression spring or the gas spring is connected to the supporting structure 100, and the other end thereof is connected to the tappet.

As shown in FIG. 4, in one of the embodiments, the transmission nailing mechanism 400 includes a lever transmission component and a nail hitting component 420 for nailing. One end of the lever transmission component is rotatably fixed on the supporting structure 100. The lever transmission component has an intermediate fulcrum. The lever transmission component is connected to the linear moving component 330 at the intermediate fulcrum. The other end of the lever transmission component is connected to the nail hitting component 420 in a transmission way. The linear moving component 330 drives the lever transmission component to move, so as to enable the lever transmission component to drive the nail hitting component 420 to hit the nail.

Figure 1:
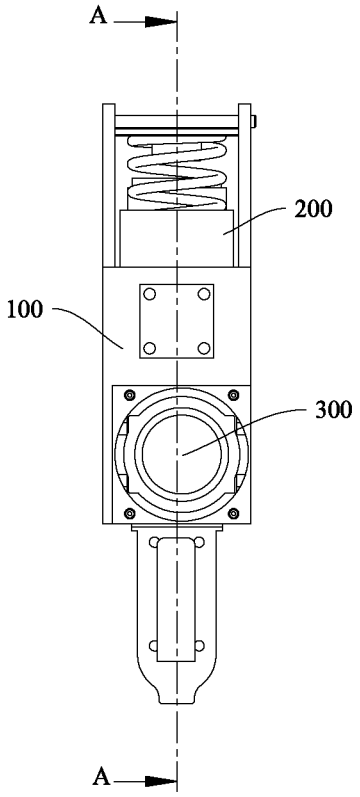
FIG. 1 is a right schematic view of a nailing device according to a first embodiment of the present disclosure.
Figure 2:
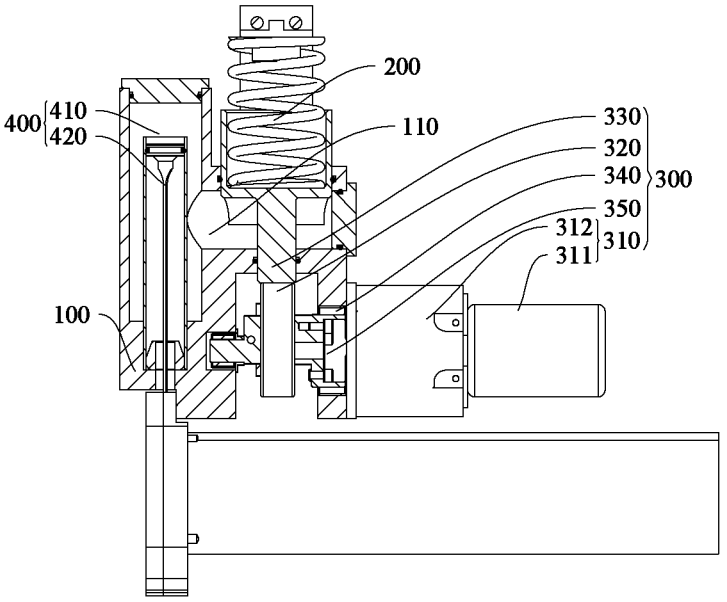
FIG. 2 is a cross-sectional schematic view of the nailing device taken along the line A-A shown in FIG. 1 in an energy storage state.

As shown in FIGS. 2 and 3, in another embodiments, the transmission nailing mechanism 400 includes a hydraulic transmission component 410 and a nail hitting component 420 for nailing. The supporting structure 100 is provided with a communicating cavity 110 as a communicating path for the hydraulic transmission component 410.

Figure 5:
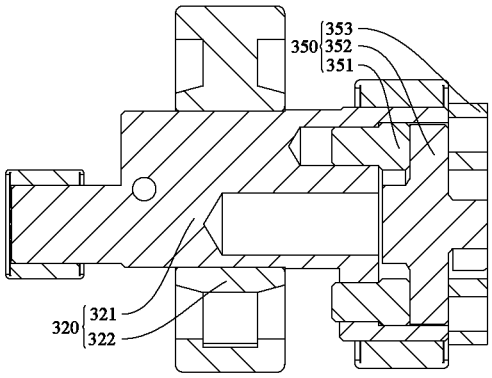
FIG. 5 is a partial assembly cross-sectional schematic view of an energy storage driving mechanism of the nailing device shown in FIG. 1.

As shown in FIGS. 3 and 5, as an optional embodiment, the eccentric component 320 includes an eccentric shaft 321 and a bearing sleeved on the eccentric shaft 321. The eccentric shaft 321 is connected to the power component 310 in a transmission way. The bearing abuts against the linear moving component 330. The power component 310 drives the eccentric shaft 321 to rotate the bearing. The bearing drives the linear moving component 330 to move linearly. Preferably, the bearing is a rolling bearing, so as to reduce the friction loss of movement transmission, such that the linear moving component 330 can move linearly without lateral friction force, thus ensuring a higher energy storage efficiency. During the energy storage, the eccentric rotation of the eccentric shaft 321 can drive the bearing to rotate eccentrically, so as to drive the linear moving component 330 to move linearly, which drives and compresses the energy storage mechanism 200 to store the energy. When the energy storage mechanism 200 releases the energy, the linear moving component 330 is pushed to move linearly, so as to drive the transmission nailing mechanism 400 to hit the nail.

The nailing device of this embodiment achieves a linear driving of the linear moving component 330 without lateral friction via a cooperation between the eccentric shaft 321 and the rolling bearing 322, which greatly eliminates the friction loss caused by the lateral force, and thus efficiently drives the energy storage mechanism 200 to store the energy. Therefore, the energy efficiency of the entire nailing device is improved, the driving force is reduced, the overall size and weight are reduced, which facilitate portability. For nailing device that uses a battery as an energy source, reducing friction loss means greatly increasing the number of nailing for a single charge of the battery, improving work efficiency, and improving the utilization rate of the battery.

Of course, in other embodiments of the present disclosure, the eccentric component 320 includes a rotating shaft and an eccentric bearing sleeved on the rotating shaft. The rotating shaft is connected to the power component 310 in a transmission way. The eccentric bearing abuts against the linear moving component 330. The power component 310 drives the rotating shaft to drive the eccentric bearing to rotate. The eccentric bearing drives the linear moving component 330 to move linearly. During the energy storage, the linear moving component 330 drives the energy storage mechanism 200 to store the energy. When the energy storage mechanism 200 releases the energy, the linear moving component 330 is driven to move linearly, so as to drive the transmission nailing mechanism 400 to hit the nail.

Figure 6:
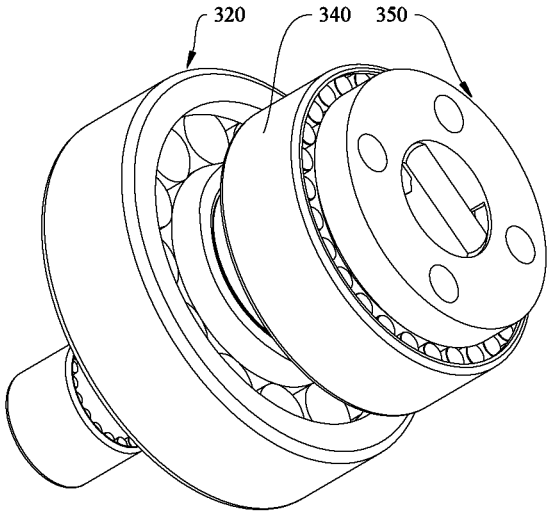
FIG. 6 is a partial assembly schematic view of the energy storage driving mechanism of the nailing device shown in FIG. 1.

In one of the embodiments, as shown in FIGS. 3 and 6, the one-way locking structure 340 is provided between the supporting structure 100 and the eccentric component 320. Optionally, the one-way locking structure 340 may be a ratchet-pawl structure or other structure that can realize the one-way locking function. Further, the one-way locking structure 340 includes a one-way bearing. One end or both ends of the eccentric component 320 are rotatably provided on the supporting structure 100 via the one-way bearing. The one-way bearing has the advantages of simple structure, strong interchangeability, stable performance, and easy disassembly.

Optionally, the position sensor may be a photoelectric sensor, angular displacement sensor, or proximity switch and the like that can sense the position information of the eccentric shaft. The position sensor may also be other sensor capable of sensing the rotational position of the eccentric component 320. The position sensor is electrically connected to the driving motor 311. When the eccentric component 320 is driven to approach the upper dead center position, the position sensor sends a signal to control the driving motor 311 to stop working. In a specific embodiment, the position sensor is a photoelectric angular displacement sensor. When the eccentric shaft 321 rotates to approach the upper dead center position indicating the state of maximum energy storage, the photoelectric angular displacement sensor sends a signal and drives the driving motor 311 to stop rotating. When receiving the nailing instruction, the driving motor 311 drives the eccentric shaft 321 to pass the upper dead center position. After the nailing is completed, the nailing device automatically enters a next energy storage process. The driving motor 311 drives the eccentric shaft 321 to rotate and store the energy. When the position sensor senses that the eccentric component 320 is at a position 0° to 20° away from the upper dead center position, the driving motor 311 stops working, and the one-way locking structure 340 reversely locks the eccentric component 320, such that the eccentric component 320 will neither rotate reversely under the driving of the energy storage mechanism 200, nor pass the upper dead center position to conduct an erroneous nailing, and the nailing device is in a state of ready to nail. When the nailing device receives the next nailing instruction, the eccentric component 320 only needs to be driven to rotate by 0° to 20° to achieve the nailing action, which greatly shortens the waiting time for nailing and ensures the nailing efficiency. Further, when the position sensor senses that the eccentric component 320 is at a position 5° to 10° away from the upper dead center position, the driving motor 311 is driven to stops working. The one-way locking structure 340 reversely locks the eccentric component 320, such that the eccentric component 320 will neither rotate reversely under the driving of the energy storage mechanism 200, nor pass the upper dead center position to conduct an erroneous nailing, and the nailing device is in a state of ready to nail. When the nailing device receives the next nailing signal, the eccentric component 320 only needs to be driven to rotate by 5° to 10° to achieve the nailing action, which greatly shortens the waiting time for nailing and ensures the nailing efficiency.

Figure 7:
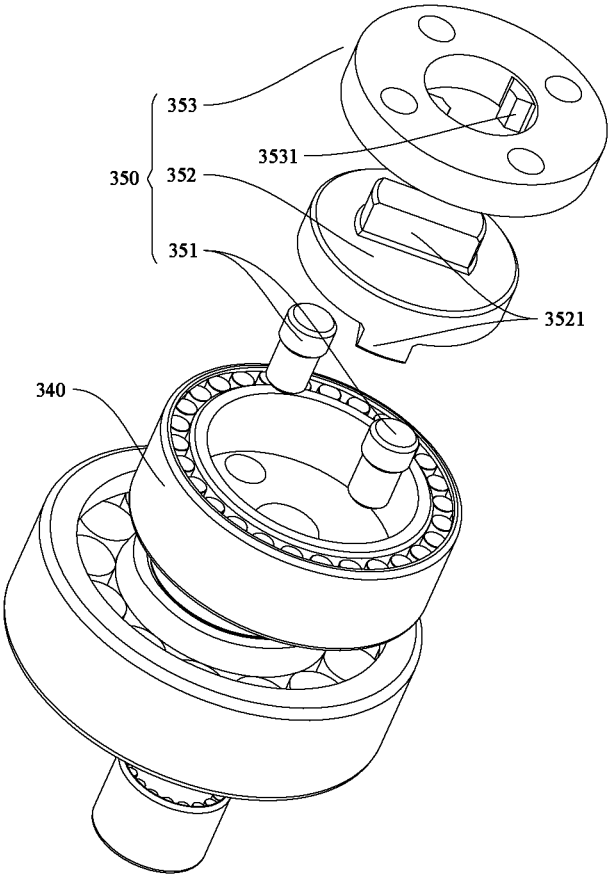
FIG. 7 is a partial exploded schematic view of the energy storage driving mechanism of the nailing device shown in FIG. 1.
Figure 8:
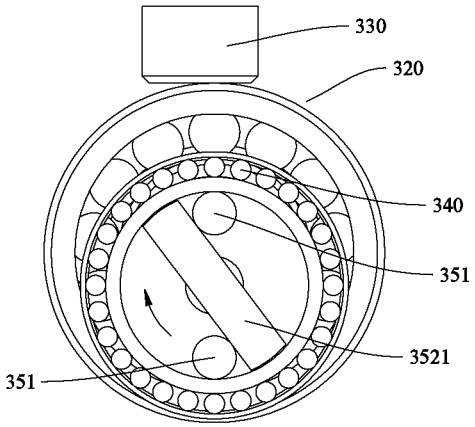
FIG. 8 is a schematic view of the energy storage driving mechanism of the nailing device shown in FIG. 1 in an upper dead center position.
Figure 11:
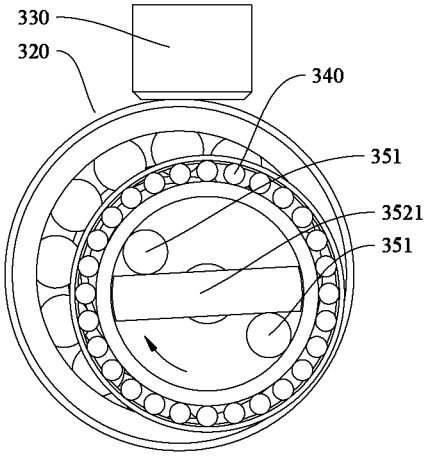
FIG. 11 is a schematic view of the energy storage driving mechanism in the nailing device shown in FIG. 1 in an energy storage state.
Figure 10:
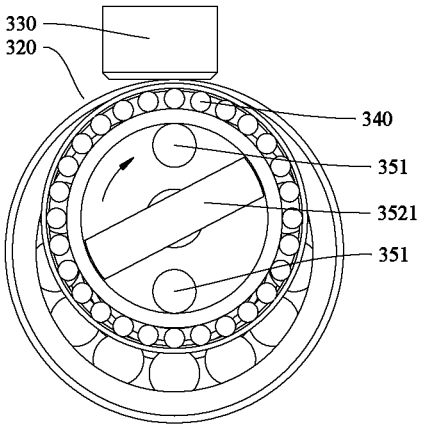
FIG. 10 is a schematic view of the energy storage driving mechanism in the nailing device shown in FIG. 1 in a complete energy release state.

As shown in FIGS. 6 and 7, in one of the embodiments, the energy storage driving mechanism 300 further includes a one-way clutch component 350. The one-way clutch component 350 is mounted between an output shaft of the power component 310 and the eccentric component 320. As shown in FIGS. 8 and 11, when the energy storage mechanism 200 stores the energy, the one-way clutch component 350 is in an engaged position. The power component 310 drives the eccentric component 320 to rotate via the one-way clutch component 350. The eccentric component 320 drives the linear moving component 330 to move linearly, so as to drive the energy storage mechanism 200 to store the energy. When the energy storage mechanism 200 releases the energy, as shown in FIGS. 9 and 10, the one-way clutch component 350 is in a disengaged position, the energy storage mechanism 200 drives the linear moving component 330 to move linearly, so as to drive the transmission nailing mechanism 400 to hit the nail, so as to drive the nail into the substrate. The one-way clutch component 350 serves to enable the energy storage mechanism 200 to quickly release energy when nailing, thereby increasing the moving speed of the mechanism when nailing, and ensuring the nailing effect.

The one-way clutch component 350 is always in the engaged position when the power component 310 drives the eccentric shaft 321 to rotate and store the energy. When the eccentric shaft 321 is driven by the energy storage mechanism and the rotational speed thereof exceeds the rotational speed of the output shaft of the power component 310, the one-way clutch component 350 is always in the disengaged position. When the one-way clutch component 350 drives the eccentric shaft 321 to rotate, the eccentric shaft 321 drives the linear moving component 330, so as to drive the energy storage mechanism 200 to store the energy. At this time, the one-way clutch component 350 is in the engaged position, and the driving motor 311 is connected to the eccentric shaft 321 by the one-way clutch component 350 in a transmission way. At this time, the power of the driving motor 311 is transmitted to the eccentric shaft 321 by the one-way clutch component 350 to drive the eccentric shaft 321 to rotate. When the energy storage mechanism 200 releases the energy, as shown in FIGS. 9 and 10, the energy storage mechanism drives the linear moving component 330 to move, and the linear moving component 330 pushes the eccentric shaft 321 to rotate. When the rotational speed of the eccentric shaft 321 exceeds the rotational speed of the output shaft of the power component 310, the one-way clutch component 350 is always in the disengaged position. In this way, the eccentric shaft 321 can rotate freely and rapidly under the driving of the linear moving component 330, which only consumes very few energy, so that most of the energy stored in the energy storage mechanism 200 is used to quickly hit the nail through the transmission nailing mechanism 400, so as to drive the nail into substrate. As shown in FIG. 11, when the energy storage mechanism 200 completely releases the energy, the one-way clutch component 350 re-enters a contacting state and performs the next energy storage process.

The nailing device of the present disclosure realizes the unidirectional transmission of the power of the driving motor 311 via the one-way clutch component 350, ensures that the driving force of the driving motor 311 can drive the eccentric shaft 321, so as to drive the linear moving component 330 to enable the energy storage mechanism 200 to store the energy, and ensures that the energy in the energy storage mechanism 200 is quickly released when nailing to ensure the nailing effect. As a possible implement, as shown in FIGS. 5 to 7, the one-way clutch component 350 includes a driving pin 351, a connecting shaft 352 and a driving plate 353 that are mounted on the eccentric component 320. The driving plate 353 is connected to the output shaft of the decelerator 312 in a transmission way. The connecting shaft 352 is rotatably connected to the driving plate 353 and forms a rotational angle gap greater than 90° therebetween. The driving pin 351 is rotatably connected to the connecting shaft 352 and forms a rotational angle gap greater than 90° therebetween. When the energy storage mechanism 200 stores the energy, the driving plate 353 and the connecting shaft 352 are in a driving contact state, and the connecting shaft 352 and the driving pin 351 are in a driving contact state. The power component 310 drives the eccentric component 320 to rotate via the driving plate 353, the connecting shaft 352, and the driving pin 351 that are contacted. The eccentric component 320 drives the linear moving component 330 to move, so as to drive the energy storage mechanism 200 to store the energy. When the energy storage mechanism 200 releases the energy, the rotational speed of the driving pin 351 is greater than the rotational speed of the connecting shaft 352, the driving pin 351 is separated from the connecting shaft 352. Similarly, the connecting shaft 352 is separated from the driving plate 353. Then, the energy storage mechanism 200 drives the transmission nailing mechanism 400 to hit the nail, so as to drive the nail into the substrate.

Further, the number of driving pins 351 is two. Two driving pins 351 are provided on the end surface of the end of the eccentric shaft 321 adjacent to the decelerator 312. The connecting line of the two driving pins 351 extends through the rotational center of the eccentric shaft 321. Both sides of the connecting shaft 352 are each provided with a transmission block 3521. The two transmission blocks 3521 are relatively fixed along the rotational direction of the eccentric shaft 321. The driving plate 353 has a transmission through hole in a center thereof. Two transmission protrusions 3531 are provided on the sidewall of the transmission through hole. A connecting line of the two transmission protrusions 3531 extends through the rotational center of the transmission plate 353. When the energy storage mechanism 200 stores the energy, the output end of the decelerator 312 drives the transmission plate 353 to rotate, and the two transmission protrusions 3531 of the transmission plate 353 are in contact with the transmission blocks 3521 on the side of the connecting shaft 352, and thus the transmission plate 353 drives the connecting shaft 352 to rotate. The transmission blocks 3521 on the other side of the connecting shaft 352 is in contact with the two transmission pins 351, and then the connecting shaft 352 drives the eccentric shaft 321 to rotate. The eccentric shaft 321 drives the linear moving component 330 to move, so as to drive the energy storage mechanism 200 to store the energy. When the energy storage mechanism 200 releases the energy, the linear moving component 330 drives the eccentric shaft 321 to rotate quickly. When the rotational speed of the driving pin 351 is greater than the rotational speed of the connecting shaft 352, and the driving pin 351 is separated from the connecting shaft 352. When the driving pin 351 reversely contacts the transmission blocks 3521 on the side of the connecting shaft 352 and drives the connecting shaft 352 to rotate, the rotational speed of the connecting shaft 352 is greater than the rotational speed of the transmission plate 353. The transmission blocks 3521 on the other side of the connecting shaft 352 is separated from the transmission protrusion 3531 of the transmission plate 353. When releasing the energy, the energy storage mechanism 200 only drives the eccentric component 320 to rotate, so that most of the energy stored in the energy storage mechanism 200 are used to quickly hit the nail through the transmission nailing mechanism 400 to drive the nail into the substrate. In other embodiments, the one-way clutch component 350 may also be a wedge-type one-way clutch, a roller-type one-way clutch, a ratchet-type one-way clutch, or other types of one-way clutch.

Embodiment 2

Figure 12:
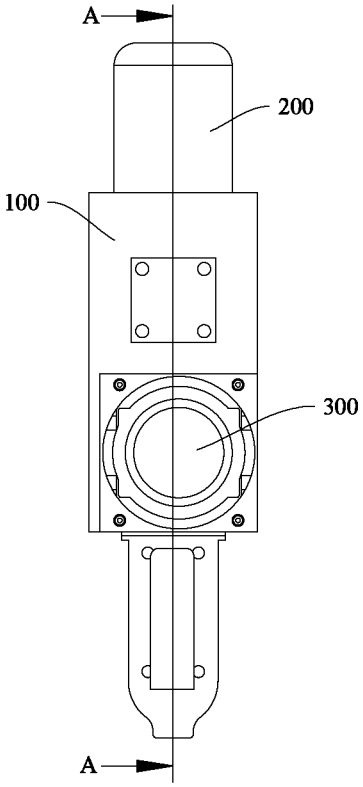
FIG. 12 is a right view of a nailing device according to a second embodiment of the present disclosure after removing a housing.
Figure 13:
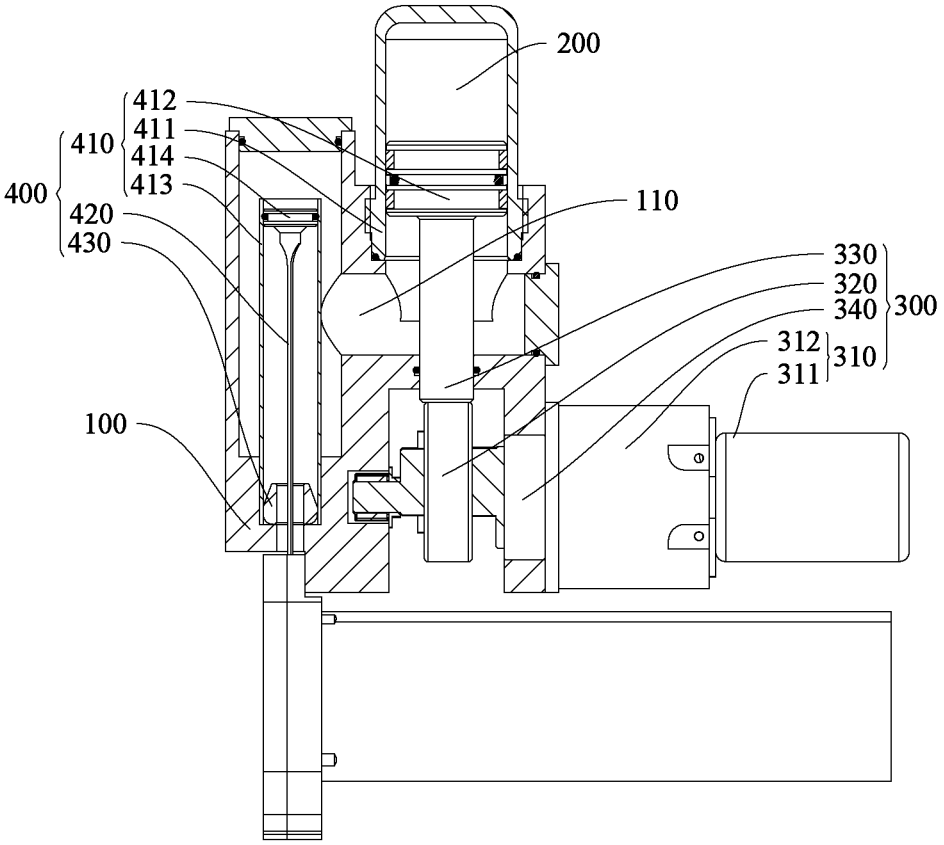
FIG. 13 is a cross-sectional view of the nailing device taken along the line A-A shown in FIG. 12 in an energy storage state.
Figure 14:
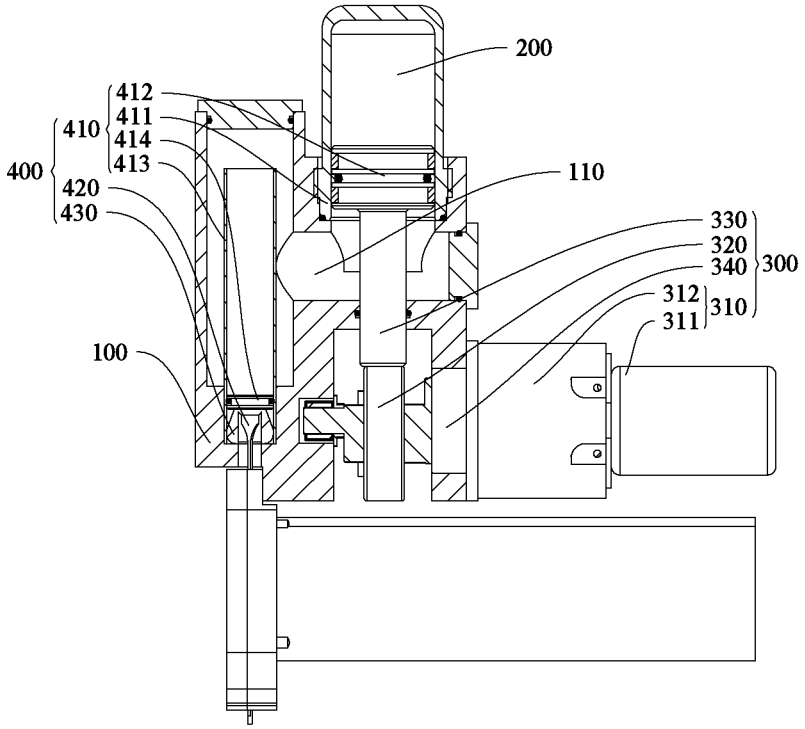
FIG. 14 is a cross-sectional view of the nailing device taken along the line A-A shown in FIG. 12 in an energy release state.

Referring to FIGS. 12, 13 and 14, FIG. 12 is a right view of a nailing device according to a second embodiment of the present disclosure, FIGS. 13 and 14 is a cross-sectional view of the nailing device taken along the line A-A shown in FIG. 12, FIG. 13 is a structural view of the nailing device in a complete energy storage state, FIG. 14 is a structural view of the nailing device in a complete energy release state. The embodiment of the present disclosure provides a nailing device capable of nailing a fixing element on a substrate, thereby enabling the fixing element to fix the component that is required to be fixed to the substrate. In this embodiment, the fixing element mainly refers to a nail. Of course, in other embodiments of the present disclosure, the fixing element may also be other fixing element similar to the nail. The nailing device according to the present disclosure obtains a large nailing force while having a compact structure, high energy efficiency, thereby improving the nailing effect.

As shown in FIGS. 12 to 14, a nailing device according to the embodiment of the present disclosure includes a supporting structure, an energy storage mechanism 200, an energy storage driving mechanism 300 and a transmission nailing mechanism 400. The energy storage mechanism 200 is provided in the supporting structure. The energy storage mechanism 200 can store or release energy. The energy storage driving mechanism 300 is provided in the supporting structure, and is used to drive the energy storage mechanism 200 to store the energy. The energy storage driving mechanism 300 includes a power component 310, an eccentric component 320 connected to the power component 310, a linear moving component 330 abutting against the eccentric component 320. The power component 310 includes a driving motor 311 and a decelerator 312 mounted on an output shaft of the driving motor 311. The transmission nailing mechanism 400 is provided in the supporting structure. The transmission nailing mechanism 400 includes a nail hitting component 420 and a hydraulic transmission component 410. The nail hitting component 420 and the energy storage mechanism 200 are connected to the hydraulic transmission component 410, respectively. The hydraulic transmission component 410 is capable of converting the energy released by the energy storage mechanism 200 into the linear movement of the nail hitting component 420, so as to drive the nail into the substrate. During the energy storage, the power component 310 drives the eccentric component 320 to rotate, so as to drive the linear moving component 330 to move linearly, thus enabling the energy storage mechanism 200 to store the energy. When the energy storage mechanism 200 releases the energy, the energy storage mechanism 200 drives the nail hitting component 420 to hit the nail via the hydraulic transmission component 410.

The nailing device uses the eccentric component 320 to drive the energy storage mechanism 200 to store the energy. When releasing the energy, a linear movement of the energy storage mechanism 200 is converted into a linear movement of the nail hitting component 420 via the hydraulic transmission component 410, so as to drive the nail into the substrate. The eccentric component 320 can reduce the friction loss during the energy storage through a rolling bearing on the eccentric shaft, and realize efficient energy storage of the energy storage mechanism 200. In an experiment, the solution of the present disclosure is adopted. A 300-watt motor and a planetary decelerator having a decelerating ratio of about 100 are used to drive the energy storage mechanism 200, 65 joules of stored energy are obtained. Under the same conditions, the conventional electric nail gun can only store less than 35 joules of energy. During the process of transmitting higher energy, the hydraulic transmission component 410 can still achieve high efficiency and stability of the transmission and have a simple and compact structure. When the energy storage mechanism 200 releases the energy, the energy storage mechanism 200 realizes rapid energy release through a one-way clutch component 340 in a disengaged state, the structure is simple and reliable, and the nailing effect is improved.

Since the energy storage driving mechanism 300 according to the present disclosure have high efficiency, and an energy releasing structure thereof is simple and reliable, which effectively solves the problems of large friction loss during the energy storage, low energy efficiency, poor mechanism reliability, and poor nailing effect of current electric nail guns, and achieves the effects of reducing driving force, reducing energy consumption, having a reduced overall size, being light in weight, and being convenient to carry.

The supporting structure is a main frame supporting structure. The supporting structure includes a mounting portion used to mount the energy storage driving mechanism 300, a mounting portion used to mount the energy storage mechanism 200, and a connecting portion used to mount the transmission nailing mechanism 400.

The decelerator 312 is provided on output shaft of the driving motor 311. The eccentric component 320 is connected to an output end of the decelerator 312, and abuts against the linear moving component 330. The movement output by the driving motor 311 is decelerated by the decelerator 312 and then transmitted to the eccentric component 320, which can increase torque and improve an energy storage driving force for the energy storage mechanism 200. Optionally, the decelerator 312 is a planetary decelerator. The nailing device of the present disclosure can be connected to an AC power source to drive the nailing device. Of course, the nailing device of the present disclosure can also be powered by a battery to drive the nailing device.

As an optional embodiment, the eccentric component 320 includes an eccentric shaft and a bearing sleeved on the eccentric shaft. The eccentric shaft is connected to the power component 310 in a transmission way. The bearing abuts against the linear moving component 330. The power component 310 drives the eccentric shaft 321 to rotate the bearing. The bearing drives the linear moving component 330 to moving linearly. Preferably, the bearing is a rolling bearing, so as to reduce the friction loss of movement transmission, such that the linear moving component 330 can move linearly without lateral friction force, thus ensuring a higher energy storage efficiency. During the energy storage, the eccentric rotation of the eccentric shaft can drive the bearing to rotate eccentrically, so as to drive the linear moving component 330 to move linearly, which drives and compresses the energy storage mechanism 200 to store the energy. When the energy storage mechanism 200 releases the energy, the linear moving component 330 is pushed to move linearly, so as to drive the transmission nailing mechanism 400 to hit the nail.

Of course, in other embodiments of the present disclosure, the eccentric component 320 includes a rotating shaft and an eccentric bearing sleeved on the rotating shaft. The rotating shaft is connected to the power component 310 in a transmission way. The eccentric bearing abuts against the linear moving component 330. The power component 310 drives the rotating shaft to drive the eccentric bearing to rotate. The eccentric bearing drives the linear moving component 330 to move linearly. During the energy storage, the linear moving component 330 drives the energy storage mechanism 200 to store the energy. When the energy storage mechanism 200 releases the energy, the linear moving component 330 is driven to move linearly, so as to drive the nail hitting component 420 to hit the nail via the hydraulic transmission component 410.

The nailing device of this embodiment linearly drives the linear moving component 330 without lateral friction through an engagement between the eccentric shaft and the rolling bearing, which greatly eliminates the friction loss caused by the lateral force, and thus efficiently drives the energy storage mechanism 200 to store the energy. Therefore, the energy efficiency of the entire nailing device is improved, the driving force is reduced, the overall size and weight are reduced, which is convenient to carry. For nailing device that uses a battery as an energy source, reducing friction loss means greatly increasing the number of nailing for a single charge of the battery, improving work efficiency, and improving the utilization rate of the battery.

In one of the embodiments, the supporting structure is provided with a communicating cavity 110 therein. The hydraulic transmission component 410 includes a first cylinder 411 and a second cylinder 413 that are communicated by the communicating cavity 110. The communicating cavity 110, the first cylinder 411, and the second cylinder 413 are fixedly provided on the supporting structure. Liquid is enclosed between the communicating cavity 110, the first cylinder 411, and the second cylinder 413. A first piston 412 is provided in the first cylinder 411. The first piston 412 is slidably engaged with the inner wall of the first cylinder 411. An end of the nail hitting component 420 away from the nail is provided with a second piston 414. The second piston 414 is slidably engaged with the inner wall of the second cylinder 413. The energy storage mechanism 200 and the nail hitting component 420 communicate with each other through cylinders having different inner diameters. By using cylinders with different inner diameters, different transmission ratios between the energy storage mechanism 200 and the nailing hitting component 420 can be easily achieved. During the energy storage, the first piston 412 moves toward the outside of the communicating cavity 110 along an axial direction of the first cylinder 411 under the driving of the linear moving component 330, so as to compress the gas spring (or mechanical spring) in the energy storage mechanism 200 to store the energy, and the liquid flows into the first cylinder 411. The second piston 414, subjected to a negative pressure and a return spring (not shown), moves toward the inside of the communicating cavity 110 along an axial direction of the second cylinder 413. When releasing the energy, the energy storage mechanism 200 pushes the first piston 412 to move toward the inside of the communicating cavity 110 along the axial direction of the first cylinder 411, and squeezes the liquid. The squeezed liquid drives the second piston 414 in the second cylinder 413 to move toward the outside of the communicating cavity 110 along the axial direction, so as to drive the nail hitting component 420 to move linearly, and to drive the nail into the substrate. In one of the embodiments, the linear moving component 330 includes a tappet. One end of the tappet abuts against the eccentric component 320, and the other end of the tappet is connected to the energy storage mechanism 200.

Figure 15:
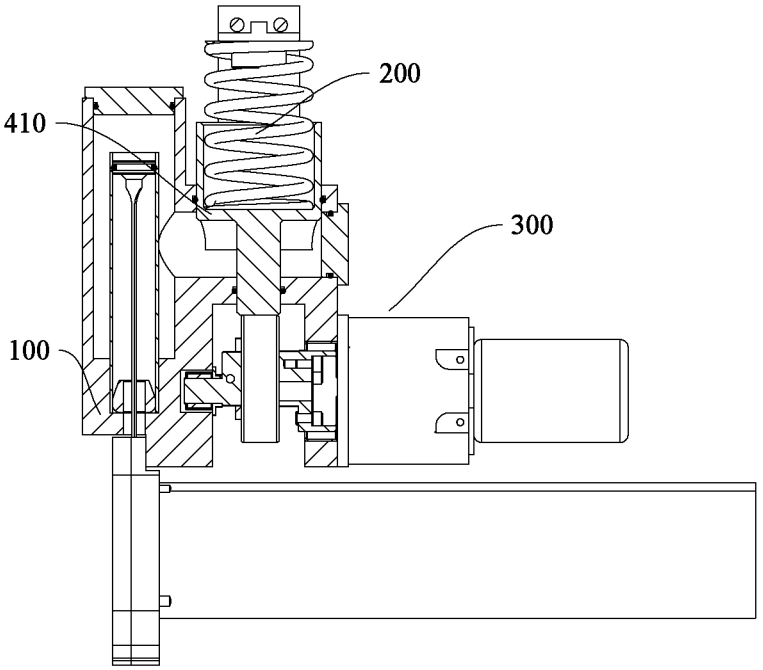
FIG. 15 is a cross-sectional view of another example of the nailing device according to the second embodiment.

In one of the embodiments, as shown in FIG. 15, the energy storage mechanism 200 includes an energy storage spring. The supporting structure is provided with a mounting cavity. The energy storage spring is mounted in the mounting cavity of the supporting structure. The tappet can drive the energy storage spring to drive the energy storage spring to store the energy. When the energy storage spring releases the energy, the energy storage spring enables the tappet to move reversely. The energy storage spring is used to store and release the energy. An axis direction of the energy storage spring is parallel to the moving direction of the tappet, so as to avoid the deflection of the energy storage spring during the energy storage. One end of the energy storage spring is in contact with the top wall of the mounting cavity, and the other end thereof abuts against one side of the first piston 412. The other side of the first piston 412 is connected to the tappet. Further, the energy storage spring is a compression spring (shown in FIG. 15) or a gas spring (shown in FIGS. 13 and 14). The compression spring or the gas spring is provided in the supporting structure. One end of the compression spring or the gas spring abuts against the supporting structure, and the other end of the compression spring or the gas spring is connected to the first piston 412. The other side of the first piston 412 is connected to the tappet. As shown in FIGS. 13 and 14, in another embodiment, the energy storage mechanism 200 achieves energy storage and energy release by compressing and releasing the enclosed gas.

In one of the embodiments, the energy storage driving mechanism 300 further includes a one-way clutch component 340. The one-way clutch component 340 is mounted between an output shaft of the power component 310 and the eccentric component 320. When the energy storage mechanism 200 stores the energy, the one-way clutch component 340 is in an engaged position. The power component 310 drives the eccentric component 320 to rotate by the one-way clutch component 340. The eccentric component 320 drives the linear moving component 330 to move linearly, so as to drive the energy storage mechanism 200 to store the energy. When the energy storage mechanism 200 releases the energy, the one-way clutch component 340 is in a disengaged position, the energy storage mechanism 200 drives the linear moving component 330 to move linearly, so as to drive the nail hitting component 420 to hit the nail via the hydraulic transmission component 410. The one-way clutch component 340 serves to enable the energy storage mechanism 200 to quickly release energy when nailing, thereby increasing the moving speed of the mechanism when nailing, and ensuring the nailing effect.

The one-way clutch component 340 is always in the engaged position when the power component 310 drives the eccentric shaft to rotate. When the rotational speed of the eccentric shaft exceeds the rotational speed of the output shaft of the power component 310, the one-way clutch component 340 is always in the disengaged position. When the one-way clutch component 340 drives the eccentric shaft to rotate, the eccentric shaft drives the linear moving component 330 to drive the energy storage mechanism 200 to store the energy. At this time, the one-way clutch component 340 is in the engaged position, and the power component 310 is connected to the eccentric shaft by the one-way clutch component 340 in a transmission way. At this time, the power of the power component 310 is transmitted to the eccentric shaft by the one-way clutch component 340 to drive the eccentric shaft to rotate. When the energy storage mechanism 200 releases the energy, the energy storage mechanism 200 drives the nail hitting component 420 to hit the nail via the hydraulic transmission component 410. Meantime, the energy storage mechanism 200 drives the linear moving component 330 to move, and the linear moving component 330 pushes the eccentric shaft to rotate. When the rotational speed of the eccentric shaft exceeds the rotational speed of the output shaft of the power component 310, the one-way clutch component 340 is always in the disengaged position, so that the eccentric shaft cannot drive the output shaft of the decelerator 312 to rotate. In this way, the eccentric shaft can freely and rapidly rotate under the drive of the linear moving component 330, which only consumes little energy, so that most of the energy stored in the energy storage mechanism 200 is used to quickly hit the nail via the hydraulic transmission component 410, so as to drive the nail into substrate.

The nailing device of the present disclosure realizes the unidirectional transmission of the power of the driving motor 311 through the one-way clutch component 340, ensures that the driving force of the driving motor 311 can drive the eccentric shaft, so as to drive the linear moving component 330 to enable the energy storage mechanism 200 to store the energy, and ensures that the energy in the energy storage mechanism 200 is quickly released when nailing to ensure the nailing effect. Optionally, the one-way clutch component 340 may be a wedge-type one-way clutch, a roller-type one-way clutch, a ratchet-type one-way clutch, or other types of one-way clutch.

Embodiment 3

Figure 16:
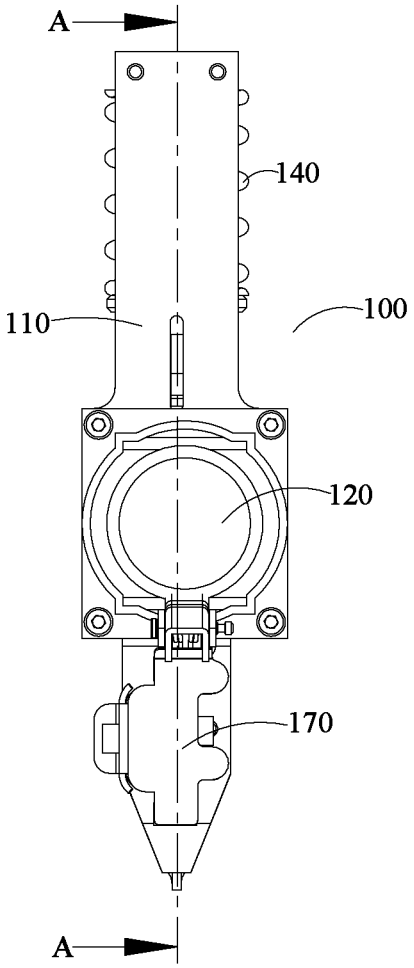
FIG. 16 is a right view of a nailing device according to a third embodiment of the present disclosure after removing a housing.
Figure 17:
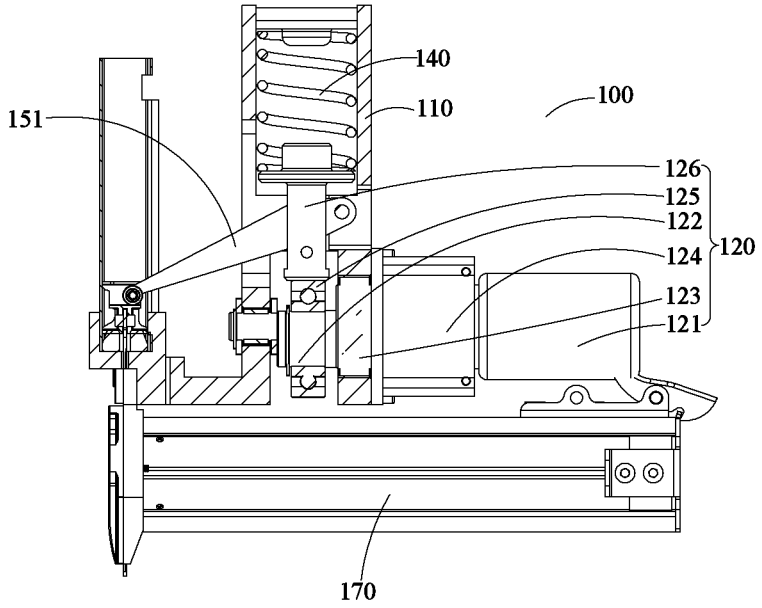
FIG. 17 is a cross-sectional view of the nailing device taken along the line A-A shown in FIG. 16.

Referring to FIGS. 16 and 17, FIG. 16 is a right view of a nailing device 100 according to a third embodiment of the present disclosure, FIG. 17 is a cross-sectional view of the nailing device 100 taken along the line A-A shown in FIG. 16. The present disclosure provides a nailing device capable of nailing a fixing element on a substrate, thereby enabling the fixing element to fix the component that is required to be fixed to the substrate. In this embodiment, the fixing element mainly refers to a nail. Of course, in other embodiments of the present disclosure, the fixing element may also be other fixing element similar to the nail. The nailing device according to the present disclosure can eliminate the friction loss caused by the lateral force, reduce the energy consumption during nailing, so that the moving speed when nailing is increased, and the energy efficiency of the entire nailing device 100 is improved, thereby improving the nailing effect.

As shown in FIGS. 16 to 17, a nailing device according to the embodiment of the present disclosure includes a main frame 110 as a supporting structure, an elastic energy storage mechanism 140, an energy storage driving mechanism 120, and a transmission nailing mechanism 150. The energy storage driving mechanism 120, the transmission nailing mechanism 150 and the energy storage mechanism 140 are connected and supported by the main frame 110.

Optionally, the supporting structure may be a main frame supporting structure. The main frame supporting structure includes a housing and a main frame 110. The housing encloses the main frame 110. The housing and the main frame 110 cooperatively support each of the moving mechanisms. Of course, the supporting structure may also be a housing supporting structure. The housing supporting structure only includes a housing or a casing. The inner wall of the housing or the casing is provided with a projecting portion. Each of the moving mechanisms is mounted on the projecting portion.

The energy storage mechanism is the elastic energy storage mechanism 140. The elastic energy storage mechanism 140 is mounted on the main frame 110. The energy storage driving mechanism 120 is a power source of the nailing device 100 of the present disclosure, and is capable of storing the energy into the elastic energy storage mechanism 140, so that the other individual components can be driven to move, so as to drive the nail. The transmission nailing mechanism 150 is movably mounted in the main frame 110 of the supporting structure. The transmission nailing mechanism 150 is connected to the elastic energy storage mechanism 140 through a linear moving component. The elastic energy storage mechanism 140 is used to store and release energy. During the energy storage, the energy storage driving mechanism 120 drives the elastic energy storage mechanism 140 to move, so that energy is stored in the elastic energy storage mechanism 140. During energy release, the elastic energy storage mechanism 140 can drive the transmission nailing mechanism 150 to move via the linear moving component, so as to drive the nail into the substrate through the transmission nailing mechanism 150.

Specifically, the energy storage driving mechanism 120 includes a power component, an eccentric component connected to the power component, the linear moving component connected to the eccentric component. The power component is fixed on the main frame 110 of the supporting structure. The eccentric component is mounted on an output shaft of the power component. The linear moving component connects the eccentric component and the elastic energy storage mechanism 140. The power component drives the eccentric component to rotate. The rotation of the eccentric component is converted into a linear movement via the linear moving component. The linear moving component drives the elastic energy storage mechanism 140 to store the energy. When the elastic energy storage mechanism 140 releases the energy, the elastic energy storage mechanism 140 pushes the transmission nailing mechanism 150 via the linear moving component, so as to drive the transmission nailing mechanism 150 to hit the nail.

Preferably, the power component includes a driving motor 121 and a decelerator 124. The driving motor 121 provides power to the elastic energy storage mechanism 140. The decelerator 124 is provided on an output shaft of the driving motor 121. The eccentric component is connected to an output end of the decelerator 124, and connected to the linear moving component. The movement output by the driving motor 121 is decelerated by the decelerator 124 and then transmitted to the eccentric component, which can increase torque and improve the energy storage driving force for the elastic energy storage mechanism 140. Optionally, the decelerator 124 is a planetary decelerator.

The nailing device 100 of the present disclosure can be connected to an AC power source to drive the nailing device 100. Of course, the nailing device 100 of the present disclosure can also be powered by a battery to drive the nailing device 100. At this time, the driving motor 121 is a direct current (DC) motor.

In this embodiment, the linear moving component may be a tappet 126. Of course, in other embodiments of the present disclosure, the linear moving component may be other structure that can move linearly. As an optionally embodiment, the eccentric component includes an eccentric shaft 122 and a bearing 125 sleeved on the eccentric shaft 122. The eccentric shaft 122 is connected to the power component 310 in a transmission way. The bearing 125 abuts against the tappet 126. The power component drives the eccentric shaft 122 to rotate the bearing 125. The bearing 125 drives the tappet 126 to moving linearly. Preferably, the bearing is a rolling bearing 125, so as to reduce the friction loss of transmission of movement, so that the tappet 126 moves linearly without lateral friction force, ensuring a higher energy storage efficiency. During the energy storage, the eccentric rotation of the eccentric shaft 122 can drive the bearing to rotate eccentrically, so as to drive the tappet 126 to move linearly via the bearing, causing the elastic energy storage mechanism 140 to be compressed to store the energy. When the elastic energy storage mechanism 140 releases the energy, the tappet 126 is pushed to move linearly, so as to drive the transmission nailing mechanism 150 to hit the nail.

Of course, in other embodiments of the present disclosure, the eccentric component includes a rotating shaft and an eccentric bearing sleeved on the rotating shaft. The rotating shaft is connected to the power component in a transmission way. The eccentric bearing abuts against the tappet 126. The power component drives the rotating shaft to drive the eccentric bearing to rotate. The eccentric bearing drives the tappet 126 to move linearly. During the energy storage, the tappet 126 drives the elastic energy storage mechanism 140 to store the energy. When the elastic energy storage mechanism 140 releases the energy, the tappet 126 is driven to move linearly, so as to drive the hitting driving mechanism 150 to move, and complete the nailing.

Optionally, the supporting mechanism may also have a guiding function. For example, the main frame 110 of the supporting structure is provided with a guiding groove for the tappet 126. The guiding groove cooperates with the linear movement of the tappet 126, so that the tappet 126 can only perform linear movement along an axial direction of the guiding groove, thus ensuring that the elastic energy storage mechanism 140 stores and releases the energy smoothly.

In this embodiment, the eccentric component includes an eccentric shaft 122 and a rolling bearing 125 sleeved on the eccentric shaft 122. The driving motor 121 can drive the eccentric shaft 122 to rotate. Since the eccentric shaft 122 and the tappet 126 are connected by the rolling bearing 125, the eccentric shaft 122 is connected to an inner ring of the rolling bearing 125, and an outer ring of the rolling bearing 125 abuts against the tappet 126. In this way, when the eccentric shaft 122 rotates, the rotation of the eccentric shaft 122 is realized by the inner ring of the rolling bearing 125, and does not drive the outer ring of the rolling bearing 125 to rotate. Moreover, the eccentric rotation of the eccentric shaft 122 can drive the rolling bearing 125 to perform eccentric rotation, so as to drive the tappet 126 to move linearly. Since the end of the tappet 126 is connected to the elastic energy storage mechanism 140, the linear movement of the tappet 126 can drive the elastic energy storage mechanism 140 to store the energy. When the elastic energy storage mechanism 140 releases the energy, the tappet 126 is pushed to move linearly, which is opposite to the linear movement during the energy storage, so as to drive the hitting driving mechanism 150 to complete the nailing.

The nailing device 100 of the present disclosure linearly drives the tappet 126 without lateral friction through an engagement between the eccentric shaft 122 and the rolling bearing 125, which greatly eliminates the friction loss caused by the lateral force, and thus efficiently drives the elastic energy storage mechanism 140 to store the energy. Therefore, the energy efficiency of the entire nailing device 100 is improved, the driving force is reduced, the overall size and weight are reduced, which is convenient to carry. For nailing device 100 that uses a battery as an energy source, reducing friction loss means greatly increasing the number of nailing for a single charge of the battery, improving work efficiency, and improving the utilization rate of the battery.

For example, through adopting the scheme of the present disclosure, the nailing device 100 of the present disclosure uses a 300-watt motor and a planetary decelerator having a decelerating ratio of about 100 to drive the elastic energy storage mechanism to store the energy, 65 joules of stored energy are obtained. Under the same conditions, the conventional electric nail gun can only store less than 35 joules of energy. It can be understood that if adopting other type of motors, the nailing device 100 of the present disclosure can better store energy to ensure the nailing effect than the conventional electric nail gun, under the same conditions.

Figure 18:
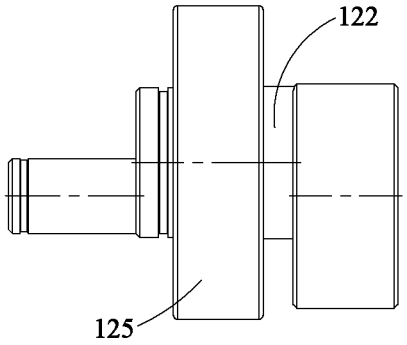
FIG. 18 is a front view of an engagement between an eccentric shaft and a rolling bearing of the nailing device shown in FIG. 17.
Figure 19:
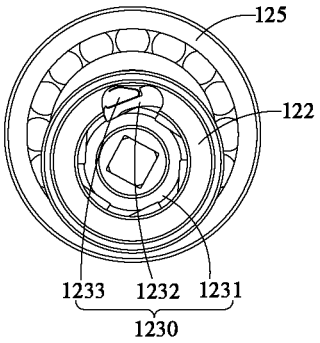
FIG. 19 is a left view of the engagement between the eccentric shaft and the rolling bearing shown in FIG. 18.

Referring to FIGS. 17 to 19, FIG. 18 is a front view of an engagement between the eccentric shaft 122 and the rolling bearing 125 in the nailing device 100 shown in FIG. 17, FIG. 19 is a left view of the engagement between the eccentric shaft 122 and the rolling bearing 125 shown in FIG. 18. The energy storage driving mechanism 300 further includes a one-way clutch component 123. The one-way clutch component 123 is mounted between an output shaft of the power component and the eccentric component. When the energy storage mechanism 140 stores energy, the one-way clutch component 123 is in an engaged position. The power component drives the eccentric component to rotate by the one-way clutch component 123. The eccentric component drives the tappet 126 to move linearly, and the tappet 126 drives the elastic energy storage mechanism 140 to store the energy. When the elastic energy storage mechanism 140 releases the energy, the one-way clutch component 123 is in a disengaged position, the elastic energy storage mechanism 140 drives the tappet 126 to move linearly, and the tappet 126 drives the transmission nailing mechanism to complete the nailing. The one-way clutch component 123 is configured to enable the elastic energy storage mechanism 140 to quickly release energy when nailing, thereby increasing the moving speed of the mechanism when nailing, and ensuring the nailing effect.

The one-way clutch component 123 is always in the engaged position when the power component drives the eccentric shaft 122 to rotate. When the rotational speed of the eccentric shaft 122 exceeds the rotational speed of the output shaft of the power component, the one-way clutch component 123 is always in the disengaged position. When the one-way clutch component 123 drives the eccentric shaft 122 to rotate, the eccentric shaft 122 drives the tappet 126, so as to drive the elastic energy storage mechanism 140 to store the energy. At this time, the one-way clutch component 123 is in the engaged position, and the driving motor 121 is connected to the eccentric shaft 122 by the one-way clutch component 123 in a transmission way. At this time, the power of the driving motor 121 is transmitted to the eccentric shaft 122 by the one-way clutch component 123 to drive the eccentric shaft 122 to rotate. When the elastic energy storage mechanism 140 releases the energy, the elastic energy storage mechanism drives the tappet 126 to move, and the tappet 126 drives the eccentric shaft 122 to rotate. When the rotational speed of the eccentric shaft 122 exceeds the rotational speed of the output shaft of the power component, the one-way clutch component 123 is always in the disengaged position, and the tappet 126 drives the transmission nailing mechanism 150 to move rapidly. When elastic energy storage mechanism 140 releases the energy, the elastic energy storage mechanism 140 drives the tappet 126 to move, so as to drive the eccentric shaft 122 to rotate, so that the one-way clutch component 123 is in the disengaged position, so that the eccentric shaft 122 cannot drive the output shaft of the decelerator 124 to rotate. In this way, the eccentric shaft 122 can freely and rapidly rotate under the drive of the tappet 126, which only consumes little energy, so that most of the energy stored in the elastic energy storage mechanism 140 is quickly output by the transmission nailing component and then used to hit the nail, so as to drive the nail into substrate.

The nailing device 100 of the present disclosure realizes the unidirectional transmission of the power of the driving motor 121 through the one-way clutch component 123, ensuring that the driving force of the driving motor 121 can drive the eccentric shaft 122 to drive the tappet 126, so as to drive the elastic energy storage mechanism 140 to store the energy, and ensuring that the energy in the elastic energy storage mechanism 140 is quickly released when nailing to ensure the nailing effect. Optionally, the one-way clutch component 123 may be a wedge-type one-way clutch, a roller-type one-way clutch, a ratchet-type one-way clutch, or other types of one-way clutch. In this embodiment, the one-way clutch component 123 is a ratchet-type one-way clutch. The ratchet-type clutch includes a ratchet wheel 1231 and a pawl 1232. The ratchet wheel 1231 is sleeved on an output shaft of the decelerator 124. The pawl 1232 is provided on the eccentric shaft 122. When the ratchet type one-way clutch is engaged, the pawl 1232 is hooked on the ratchet wheel 1231. The decelerator 124 will transmit the driving torque to the ratchet wheel 1231, and the ratchet wheel 1231 rotates and drives the pawl 1232 to push the eccentric shaft 122 to rotate. The eccentric shaft 122 pushes the tappet 126 to move linearly through the rolling bearing 125, so that the elastic energy storage mechanism 140 stores energy. After the energy storage is completed, and after the eccentric shaft 122 passes through the dead point, the ratchet one-way clutch is in a disengaged state, the pawl 1232 passes through the ratchet wheel 1231, and the tappet 126 is pushed by the elastic energy storage mechanism 140 to move. The eccentric shaft 122 does not drive the decelerator 124 to move, and rotates by itself rapidly. Then, the energy stored in the elastic energy storage mechanism 140 is quickly output through the nailing mechanism to complete the nailing. The ratchet-type one-way clutch further includes an elastic component 1233. The elastic component 1233 is provided on the eccentric shaft 122 and abuts against the ratchet wheel 1231 to ensure the one-way clutch function of the one-way clutch during the energy storage and energy release.

As a possible implement, the main frame 110 as the supporting structure includes a mounting portion used to mount the energy storage driving mechanism 120 and a connecting portion used to mount the transmission nailing mechanism 150. In this embodiment, both the mounting portion and the connecting portion are parts of the main frame 110. The mounting portion has a mounting hole. The power component is mounted on the mounting portion. The eccentric shaft 122 is inserted into the mounting hole. The mounting portion has a mounting cavity. The elastic energy storage mechanism 140 is provided in the mounting cavity. Moreover, the main frame 110 can be formed by an integrated molding method, which reduces the assembly process, and also ensures the reliability of the mechanism.

Further, the elastic energy storage mechanism 140 includes an energy storage spring. The main frame 110 is provided with a mounting cavity. The energy storage spring is mounted in the mounting cavity of the supporting structure. The tappet 126 can drive the energy storage spring, so as to drive the energy storage spring to store the energy. When the energy storage spring releases the energy, the energy storage spring reverses the tappet 126. The energy storage spring is used to store and release energy. An axis direction of the energy storage spring is parallel to the moving direction of the tappet 126, so as to avoid the deflection of the energy storage spring during the energy storage. One end of the energy storage spring is in contact with the top wall of the mounting cavity, and the other end thereof is in contact with the tappet 126.

Preferably, the energy storage spring is a compression spring or a gas spring. The compression spring or the gas spring is provided in the supporting structure. One end of the compression spring or the gas spring abuts against the supporting structure, and the other end of the compression spring or the gas spring abuts against the tappet 126.

Figure 20:
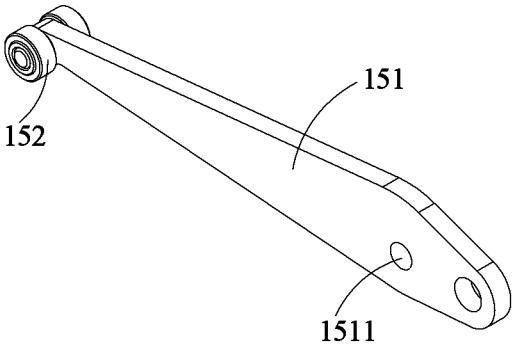
FIG. 20 is a perspective view of a lever transmission structure in the nailing device shown in FIG. 17.

Referring to FIGS. 17 and 20, FIG. 20 is a perspective view of a lever transmission component 151 in the nailing device 100 shown in FIG. 17. Optionally, the transmission nailing mechanism 150 includes the lever transmission component 151 and a nailing component for nailing. One end of the lever transmission component 151 is rotatably fixed to the supporting structure. The lever transmission component 151 has an intermediate fulcrum 1511. The lever transmission component 151 is connected to the tappet 126 at the intermediate fulcrum 1511. The other end of the lever transmission component 151 is connected to the nail hitting component in a transmission way. The tappet 126 drives the lever transmission component 151 to move, so that the lever transmission component 151 drives the nail hitting component to hit the nail. When the elastic energy storage mechanism 140 releases the energy, the elastic energy storage mechanism 140 drives the tappet 126 to move, and outputs the energy quickly through the lever transmission component 151, so that the nail hitting component is driven to move to hit the nail, so as to complete the nailing. Optionally, the nail hitting component includes a striker slider. One end of the lever transmission component 151 is connected to the striker slider. Of course, in other embodiments of the present disclosure, the nail hitting component may also be an ejector rod or other component capable of impacting the nail.

Further, the distance between the intermediate fulcrum 1511 of the lever transmission component 151 and a connecting position of the lever transmission component 151 and the nail hitting component is 5 times to 10 times greater than the distance between the intermediate fulcrum 1511 of the lever transmission component 151 and a connecting position of the lever transmission component 151 and the supporting structure. The distance from the intermediate fulcrum 1511 of the lever transmission component 151 to both ends thereof can adjust the output speed of the lever transmission component 151. When the distance between the intermediate fulcrum 1511 of the lever transmission component 151 and the connecting position of the lever transmission component 151 and the nail hitting component is greater than the distance between the intermediate fulcrum 1511 of the lever transmission component 151 and the connecting position of the lever transmission component 151 and the main frame 110 of the supporting structure, the moving speed of the elastic energy storage mechanism 140 when releasing the energy can be adjusted to the moving speed of the nail hitting component. Specifically, the moving speed of the elastic energy storage mechanism 140 when releasing the energy is increased to the moving speed of the nail hitting component, which is increased by 5 times to 10 times, so that the nailing speed of the nail hitting component hitting the nail is 5 times to 10 times greater than the moving speed of the elastic energy storage mechanism 140, thereby increasing the striking speed of the striker, greatly increasing the nailing effect.

Optionally, the transmission nailing mechanism 150 further includes a sliding mechanism as a nail hitting mechanism. The sliding mechanism is connected to the main frame 110 of the supporting structure. The sliding mechanism is connected to the lever transmission component 151. The energy released by the elastic energy storage mechanism 140 is transmitted to the lever transmission component 151 through the tappet 126, so that the lever transmission component 151 can drive a slider in the sliding mechanism, so as to drive the nail hitting component, thereby driving the nail into the substrate. Specifically, the sliding mechanism includes a sliding channel and a slider slidably provided in the sliding channel. The slider is fixedly connected with the nail hitting component. The slider moves linearly in the sliding channel along the axial direction, subjected to the lever transmission component 151, so that the striker hits the nail to achieve the nailing.

The lever transmission component 151 is further provided with a roller 152. The roller 152 are rollably provided on an end of the lever transmission component 151 connected to the slider. The slider is provided with a sliding groove in the moving direction of the lever transmission component 151. The roller 152 is rollably provided in the sliding groove. Since the tappet 126 will drive the end of the lever transmission component 151 to perform an arc-shaped movement when the elastic energy storage mechanism 140 releases the energy, in order to avoid the interference between the movement of the slider driven by the lever transmission component 151 and the sliding channel, the roller 152 are provided at the connecting portion between the lever transmission component 151 and the slider, and the sliding groove is provided on the slider, so that roller 152 can roll in the sliding groove. In this way, when the end of the lever transmission component 151 performs the arc-shaped movement, the lever transmission component 151 can slide in the sliding groove by the roller 152, so as to avoid the interference generated when the lever transmission component 151 drives the slider to move, and reduce the lateral force, so that the lever transmission component 151 can drive the slider to move linearly along the sliding channel without any obstacles, ensuring that the slider moves at a high-speed, thereby increasing the hitting speed of the nail hitting component driven by the slider, ensuring the nailing effect. Meanwhile, the cooperation between the lever transmission component 151 and the slider through the roller 152 can also reduce friction, to reduce the friction loss during nailing.

Further, the transmission nailing mechanism 150 further includes a connecting rod. One end of the connecting rod is rotatably connected to the lever transmission component 151, and the other end of the connecting rod is rotatably connected to the tappet 126. That is, the intermediate fulcrum 1511 of the lever transmission component 151 is connected to the tappet 126 through the connecting rod, so that the energy released by the elastic energy storage mechanism 140 is transmitted to the lever transmission component 151 through the tappet 126 and the connecting rod, ensuring the lever transmission component 151 to move flexibly and reliably.

Figure 21:
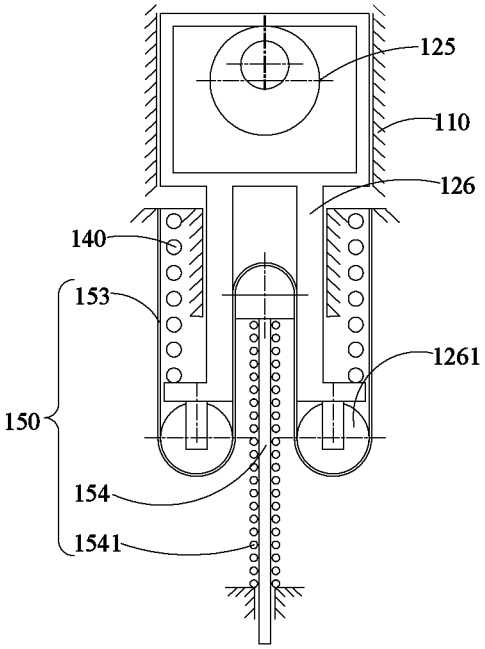
FIG. 21 is a structural schematic view of another example of the nailing device shown in FIG. 16.

In another embodiment of the present disclosure, the nailing mechanism may further include a belt driving component and a nail hitting component. That is, the lever transmission component 151 is replaced by a belt driving component, referring to FIG. 21. It should be noted that the lever transmission component 151 of the present disclosure may be replaced by other structures capable of causing the elastic energy storage mechanism 140 to output the energy to the nail hitting component, in addition to the belt driving component.

Specifically, the belt driving component includes a transmission belt 153. The nail hitting component includes a nail driver 154 and a return spring 1541 sleeved on the nail driver 154. Two movable pulleys 1261 are provided on the tappet 126. The outer ring of the rolling bearing 125 abuts against the tappet 126. The movable pulleys 1261 are rotatably connected to the tappet 126. The transmission belt 153 is wound around the two movable pulleys 1261 and connected to an end of the nail driver 154. Both ends of the transmission belt 153 are fixed on the main frame 110 as the supporting structure. The elastic energy storage mechanism 140 is located in the space enclosed by the transmission belt 153 and the tappet 126. The elastic energy storage mechanism 140 abuts against the tappet 126 and the main frame 110. The return spring 1541 is sleeved on the nail driver 154 and abuts against the main frame 110. When the eccentric rotation of the eccentric shaft 122 drives the tappet 126 to move up through the rolling bearing 125, the elastic energy storage mechanism 140 is compressed to store the energy. Meanwhile, the two movable pulleys 1261 move upward to loosen the transmission belt 153, and the nail driver 154 moves upward subjected to restoring force of the return spring 1541, so as to tension the transmission belt 153. When the elastic energy storage mechanism 140 releases the energy, the tappet 126 moves downward, and the movable pulleys 1261 moves downward to tension the transmission belt 153, pushing the nail driver 154 to accelerate downward, so as to hit the nail, driving the nail into the substrate.

Optionally, the nailing device 100 further includes a nail box 170. The nail box 170 is connected to the supporting structure. A discharge port of the nail box 170 is provided corresponding to the striker. The nail box 170 is used to store nails. The nailing device 100 further includes an automatic nail delivery mechanism. The automatic delivery mechanism is provided in the nail box 170 to automatically deliver the nails. When the nailing device 100 works, after the striker hits the nail into the substrate, the automatic delivery mechanism in the nail box 170 delivers the nail to the striker, and the lever transmission component 151 drives the nail hitting component to hit the nail again, driving the nail to the corresponding position of the substrate. Such a cycle is repeated to realize automatic operation, which is convenient and practical.

When the nailing device 100 of the present disclosure performs nailing work, the power generated by the driving motor 121 is decelerated by the decelerator 124 and output to the one-way clutch component 123. When the one-way clutch component 123 is in the engaged position, the ratchet wheel 1231 of the one-way clutch component 123 engages with the pawl 1232 on the eccentric component to drive the eccentric shaft 122 to rotate. The eccentric shaft 122 drives the tappet 126 to move linearly through the rolling bearing 125, and compresses the elastic energy storage mechanism 140, so that the energy storage spring stores the energy.

When the eccentric shaft 122 rotates to pass the dead point, the energy storage spring releases the energy, and the tappet 126 is driven by the elastic energy storage mechanism 140 to move. Since the pawl 1232 is separated from the ratchet wheel 1231, and the eccentric shaft 122 does not drive the decelerator 124 to move, but rotates by itself quickly, so that the energy stored by the energy storage spring is quickly output through the lever transmission component 151, which drives the slider to move along the sliding channel, so that the slider drives the nail hitting component to move, so as to drive the nail hitting component to hit the nail and complete the nailing.

Finally, it should also be noted that in this description, relational terms such as first and second are used only to distinguish one entity or operation from another entity or operation, and do not necessarily require or imply that there is any of such relationship or order between these entities or operations. Moreover, the terms "include", "including" or any other variant thereof are intended to cover non-exclusive inclusion, so that a process, method, article, or device that includes a series of elements includes not only those elements, but also those not explicitly listed, or further includes elements that are inherent to such process, method, article, or device. Without more limitations, an element defined by the sentence "including one . . . " does not exclude that there are other identical elements in the process, method, article or device that includes the element.

The embodiments in this specification are described in a progressive manner. Each embodiment focuses on the differences from other embodiments, and the same or similar parts between the embodiments may refer to each other.

The above description of the disclosed embodiments enables those skilled in the art to implement or use this disclosure. Various modifications to these embodiments will be apparent to those skilled in the art. The general principles defined herein can be implemented in other embodiments without departing from the spirit or scope of the present disclosure. Therefore, the present disclosure will not be limited to the embodiments illustrated herein, but should conform to the widest scope consistent with the principles and novel features disclosed herein.

What is claimed is:

1. A nailing device, comprising:

a supporting structure;

an energy storage mechanism provided in the supporting structure and capable of storing or releasing energy;

an energy storage driving mechanism provided in the supporting structure and configured to drive the energy storage mechanism to store energy, wherein the energy storage driving mechanism comprises a power component, an eccentric component connected to the power component, and a linear moving component connected to the eccentric component, the power component comprises a driving motor and a decelerator mounted on an output shaft of the driving motor;

a transmission nailing mechanism, wherein the energy storage mechanism drives the transmission nailing mechanism to hit a nail, so as to drive the nail into a substrate;

wherein during energy storage, the power component drives the eccentric component to rotate, so as to drive the linear moving component to move linearly, and enable the energy storage mechanism to store energy; when the energy storage mechanism releases energy, the energy storage mechanism drives the transmission nailing mechanism to hit the nail;

wherein the energy storage driving mechanism further comprises a one-way clutch component mounted between an output shaft of the power component and the eccentric component;

when the energy storage mechanism stores the energy, the one-way clutch component is in an engaged position, the power component drives the eccentric component to rotate via the one-way clutch component, and the eccentric component drives the linear moving component to move, so as to drive the energy storage mechanism to store energy;

when the energy storage mechanism releases the energy, the one-way clutch component is in a disengaged position, and the energy storage mechanism drives the transmission nailing mechanism to hit the nail quickly, so as to drive the nail into the substrate.

2. The nailing device according to claim 1, wherein the energy storage driving mechanism further comprises a one-way locking structure and a position sensor, the one-way locking structure is provided at the eccentric component, the one-way locking structure restricts the eccentric component to rotate in a single direction, the position sensor is capable of sensing a rotational position of the eccentric component;

during the energy storage, the power component drives the eccentric component to rotate, so as to drive the linear moving component to move linearly, and enable the energy storage mechanism to store energy; when the position sensor senses that the eccentric component approaches an upper dead center position, the driving motor stops working, and the one-way locking structure reversely locks the eccentric component; during nailing, the driving motor drives the eccentric component to rotate, so as to pass the upper dead center position, such that the energy storage mechanism releases the energy and drives the transmission nailing mechanism to hit the nail, so as to drive the nail into the substrate.

3. The nailing device according to claim 2, wherein during the energy storage, when the position sensor senses that the eccentric component is in a position 0° to 20° away from the upper dead center position, the driving motor stops working.

4. The nailing device according to claim 1, wherein the transmission nailing mechanism is provided in the supporting structure; the transmission nailing mechanism is connected to the linear moving component, and converts a movement of the linear moving component into a linear movement of the transmission nailing mechanism, so as to drive the nail into the substrate;

during the energy storage, the power component drives the eccentric component to rotate, so as to drive the linear moving component to move linearly, and enable the energy storage mechanism to store energy;

when the energy storage mechanism releases the energy, the energy storage mechanism drives the transmission nailing mechanism to hit the nail via the linear moving component.

5. The nailing device according to claim 4, wherein the transmission nailing mechanism comprises a nail hitting component and a hydraulic transmission component; the nail hitting component and the energy storage mechanism are connected to the hydraulic transmission component, respectively; the hydraulic transmission component is capable of converting the energy released by the energy storage mechanism into the linear movement of the nail hitting component, so as to drive the nail into the substrate;

during the energy storage, the power component drives the eccentric component to rotate, so as to drive the linear moving component to move linearly, and enable the energy storage mechanism to store energy;

when the energy storage mechanism releases the energy, the energy storage mechanism drives the nail hitting component to hit the nail via the hydraulic transmission component.

6. The nailing device according to claim 5, wherein the supporting structure is provided with a communicating cavity therein; the hydraulic transmission component comprises a first cylinder and a second cylinder that are communicated by the communicating cavity; the communicating cavity, the first cylinder, and the second cylinder are fixedly provided on the supporting structure; liquid is enclosed between the communicating cavity, the first cylinder, and the second cylinder; the first cylinder is provided with a first piston therein; the first piston is slidably engaged with an inner wall of the first cylinder; an end of the nail hitting component away from the nail is provided with a second piston; the second piston is slidably engaged with an inner wall of the second cylinder;

when releasing the energy, the energy storage mechanism pushes the first piston to squeezes the liquid in the communicating cavity, the liquid drives the second piston, the second piston drives the nail hitting component to move linearly, so as to drive the nail into the substrate.

7. The nailing device according to claim 4, wherein the transmission nailing mechanism comprises a lever transmission component and a nail hitting component for nailing; one end of the lever transmission component is rotatably mounted on the supporting structure; the lever transmission component has an intermediate fulcrum; the lever transmission component is connected to the linear moving component at the intermediate fulcrum; the other end of the lever transmission component is connected to the nail hitting component in a transmission way;

the linear moving component drives the lever transmission component to move, so as to enable the lever transmission component to drive the nail hitting component to hit the nail.

8. The nailing device according to claim 1, wherein the one-way clutch component comprises a driving pin, a connecting shaft, and a driving plate that are mounted on the eccentric component; the driving plate is connected to an output shaft of the decelerator in a transmission way; the connecting shaft is rotatably connected to the driving plate and forms a rotational angle gap greater than 90° therebetween; the driving pin is rotatably connected to the connecting shaft and forms a rotational angle gap greater than 90° therebetween;

when the energy storage mechanism stores the energy, the driving plate and the connecting shaft are in a driving contact state, the connecting shaft and the driving pin are in a driving contact state; the power component drives the eccentric component to rotate via the driving plate, the connecting shaft, and the driving pin that are contacted; the eccentric component drives the linear moving component to move, so as to drive the energy storage mechanism to store the energy;

when the energy storage mechanism releases the energy, a rotational speed of the driving pin is greater than a rotational speed of the connecting shaft, the driving pin is separated from the connecting shaft; similarly, the connecting shaft is separated from the driving plate; the energy storage mechanism drives the transmission nailing mechanism to hit the nail, so as to drive the nail into the substrate.

9. The nailing device according to claim 1, wherein the energy storage mechanism comprises a compression spring or a gas spring.

10. The nailing device according to claim 1, wherein the eccentric component comprises an eccentric shaft and a bearing sleeved on the eccentric shaft.

* * * * *